US007141744B2

(12) United States Patent
Cloutier

(10) Patent No.: US 7,141,744 B2
(45) Date of Patent: Nov. 28, 2006

(54) WIRE GROMMET

(75) Inventor: Michel Cloutier, Nicolet (CA)

(73) Assignee: Nicolet Plastique Ltee, Quebec (CA)

( * ) Notice: Subject to any disclaimer, the term of this patent is extended or adjusted under 35 U.S.C. 154(b) by 0 days.

(21) Appl. No.: 11/250,858

(22) Filed: Oct. 14, 2005

(65) Prior Publication Data

US 2006/0108139 A1 May 25, 2006

(30) Foreign Application Priority Data

Nov. 22, 2004 (CA) ..... 2486814

(51) Int. Cl.
*H02G 3/18* (2006.01)

(52) U.S. Cl. ..... 174/650; 174/153 G; 174/152 G; 174/135; 16/2.1; 16/2.2; 248/56

(58) Field of Classification Search ..... 174/65 G, 174/151, 152 G, 153 G, 135, 65 R, 152 R, 174/155, 156, 650, 652, 656, 665, 668, 669; 16/2.1, 2.2; 248/56; D8/356, 400; 439/604, 439/587, 274, 275

See application file for complete search history.

(56) References Cited

U.S. PATENT DOCUMENTS 3,161,906 A * 12/1964 Yarm ..... 16/2.1
3,836,269 A * 9/1974 Koscik ..... 16/2.2
3,958,300 A * 5/1976 Tanaka ..... 174/153 G
4,053,701 A * 10/1977 Ogilvie et al. ..... 16/2.1
5,639,993 A * 6/1997 Ideno et al. ..... 174/153 G
6,218,625 B1 * 4/2001 Pulaski ..... 174/153 G
6,627,817 B1 * 9/2003 Kortenbach ..... 174/65 G
6,632,999 B1 * 10/2003 Sempliner et al. ..... 174/65 G
6,694,566 B1 * 2/2004 Mockett ..... 16/2.1

* cited by examiner

*Primary Examiner*—Angel R. Estrada
(74) *Attorney, Agent, or Firm*—Darby & Darby

(57) ABSTRACT

Disclosed is a wire grommet intended to be positioned in a hole made into a surface of a panel or plate. The grommet is made of two identical elements having adjacent edges provided with tongues and grooves allowing them to be assembled to form an open container with a size and shape adapted to allow it to be inserted into the hole and be maintained within the same. The elements also have recesses in their edges which altogether form at least one opening through which one or more wires may pass when the elements are assembled. Advantageously, the wire grommet also comprises a closing cap fittable into both elements when the elements are assembled, in order to close the container formed by the same.

5 Claims, 4 Drawing Sheets

WIRE GROMMET

FIELD OF THE INVENTION

The present invention relates to a wire grommet intended to be positioned in a hole made in a surface of a panel or plate, especially a table or a desk. This wire grommet is devised to let one or more wires pass through it while also acting as a pen holder or a storing space.

TECHNOLOGICAL BACKGROUND

In the field of furniture, especially desks, tables or shelves, it is of common practice to provide holes in the surface of plates or panels so as to pass wires necessary to connect the electrical or electronic equipment. However, in practice, these holes often remain unused.

SUMMARY OF THE INVENTION

The object of the present invention is to provide a piece intended to be inserted into a hole made into a plate or a panel in order to, on the one hand, always permit to this hole to act as a wire grommet and, on the other hand, act as a pen holder or form a storing space.

More specifically, the invention is directed to a wire grommet intended to be positioned into a hole made into the surface of a panel or plate. This grommet comprises two identical elements having adjacent edges provided with tongues and grooves allowing their assembly to form an open container with a size and shape adapted to allow it to be inserted into the hole and be maintained within the same. The elements also have recesses in their edges which altogether form at least one opening through which one or more wires may pass when the elements are assembled.

Preferably, the wire grommet also comprises a closing cap fittable into both elements when the elements are assembled, in order to close the container formed by the same. The motion of the cap during its insertion into the container, is limited by an edge acting as a stop.

The invention will be better understood upon reading the following non-restrictive description of a preferred embodiment thereof, made with reference to the accompanying drawings.

DESCRIPTION OF A PREFERRED EMBODIMENT OF THE INVENTION

The wire grommet 1 according to the preferred embodiment of the invention shown in the accompanying drawings, are made of two identical elements 3 and 5 which form an open container when they are assembled together. In order to proceed to this assembly, tongues 9 and grooves 11 are provided into the lateral edges of the elements 3 and 5 in order to assemble and disassemble the same at will. Tongues and grooves may also be provided on the bottom of each of the elements so as to complete their assembly.

Figure 1:
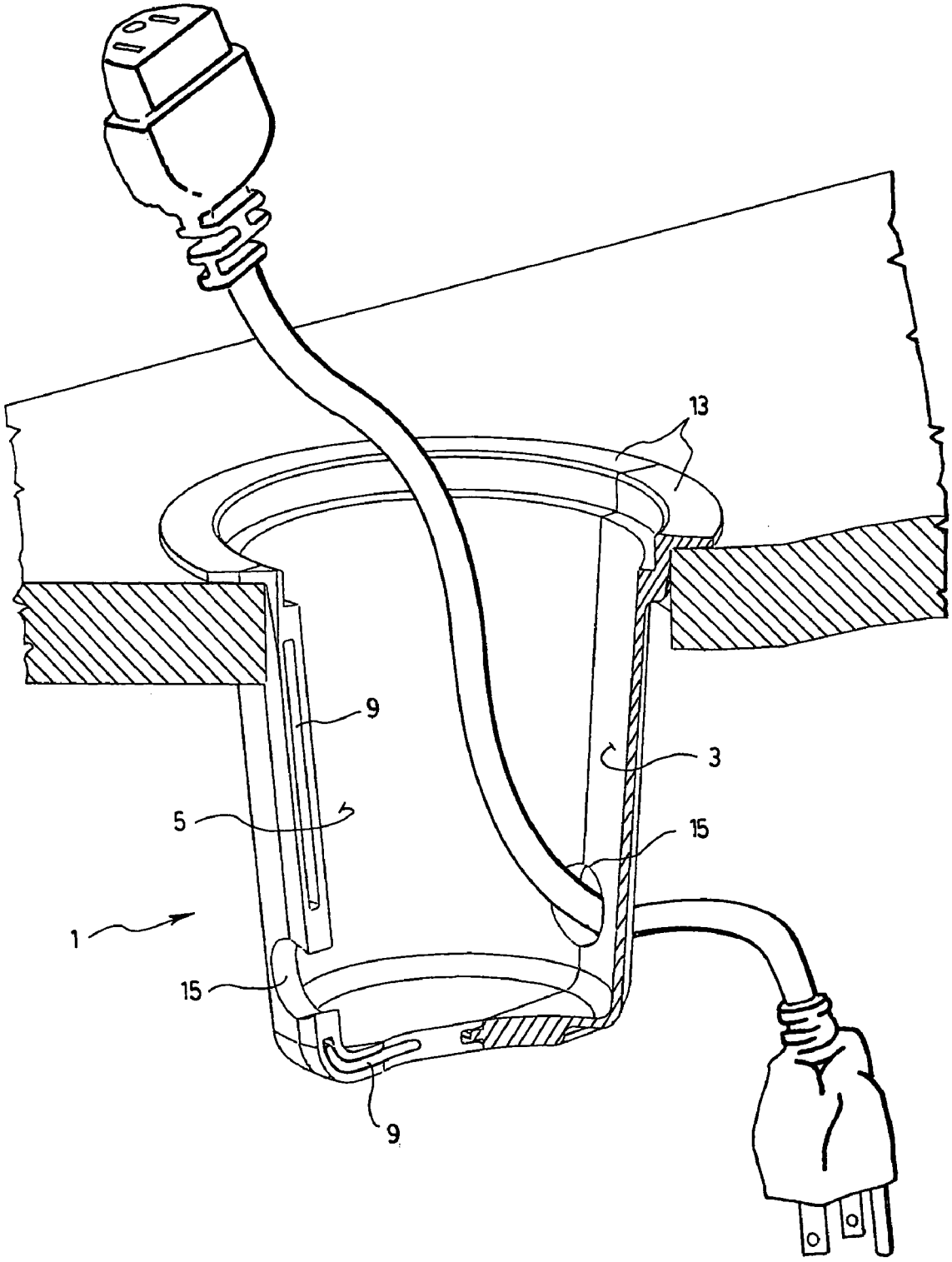
FIG. 1 is a perspective view in partial cross-section of a wire grommet according to the invention installed in a hole made into a surface of a panel or plate.

Each element 3, 5 comprises an upper rim 13 which projects outwardly in order to fit onto the edges of the hole of the panel into which the wire grommet is intended to be positioned (see FIG. 1). The upper rim 13 may also mask the imperfections that may exist all around the hole, especially if this one is made into the panel by a user.

Each of the elements 3, 5 also comprises at least one recess 15 on one of its edges preferably close to its bottom in order to, once both elements are assembled around a wire, let this wire pass through the same as is clearly shown in FIG. 1.

Figure 2:
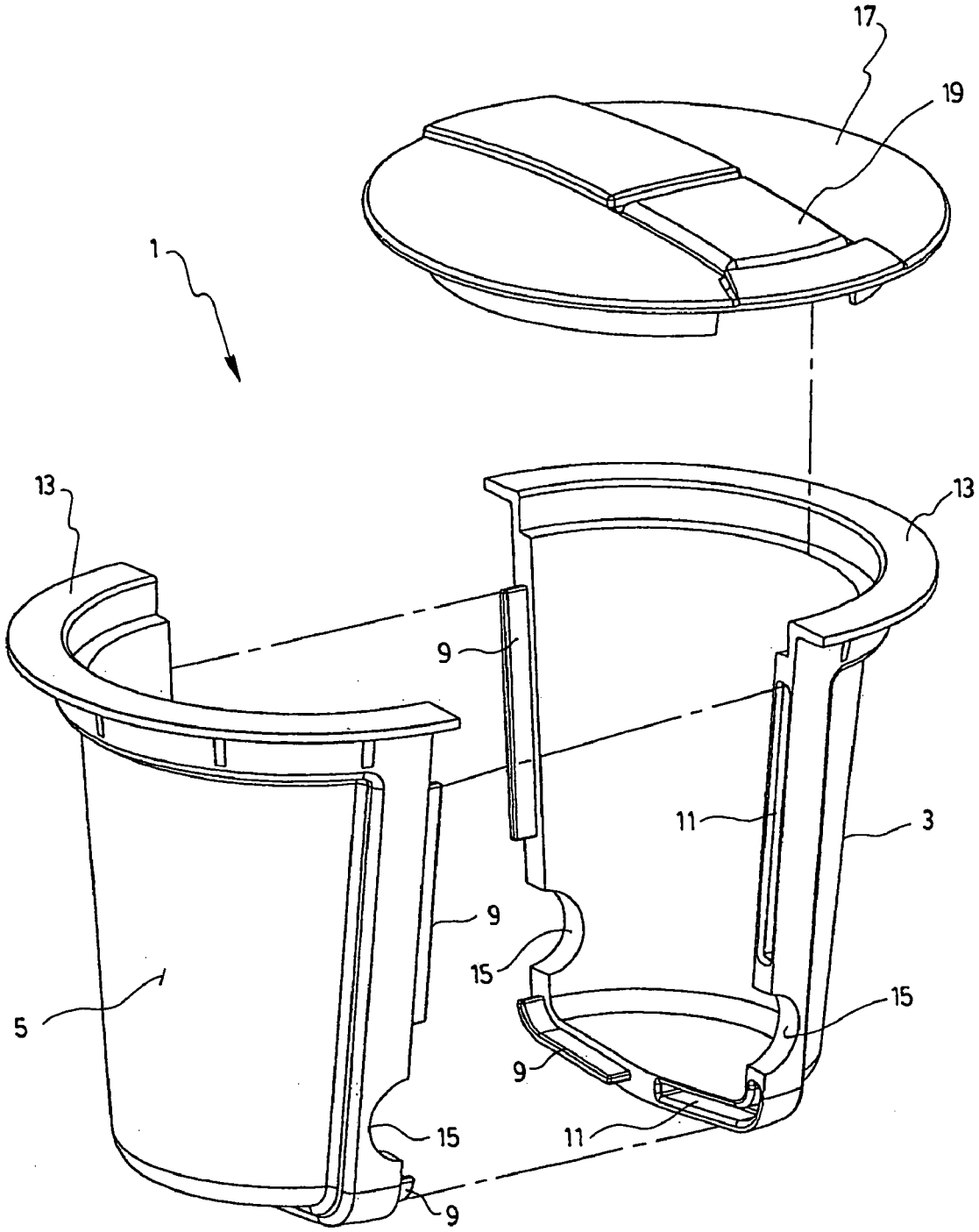
FIG. 2 is an exploded perspective view of the wire grommet shown in FIG. 1, which illustrates the two basic elements forming the same, as well as its lid.
Figure 4:
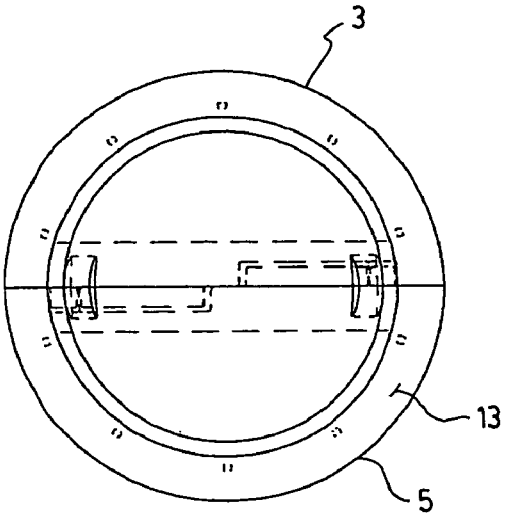
FIGS. 3 to 6 are perspective view, a top plan view, a front elevational view and a side elevational view of the wire grommet shown in FIGS. 1 and 2.
Figure 3:
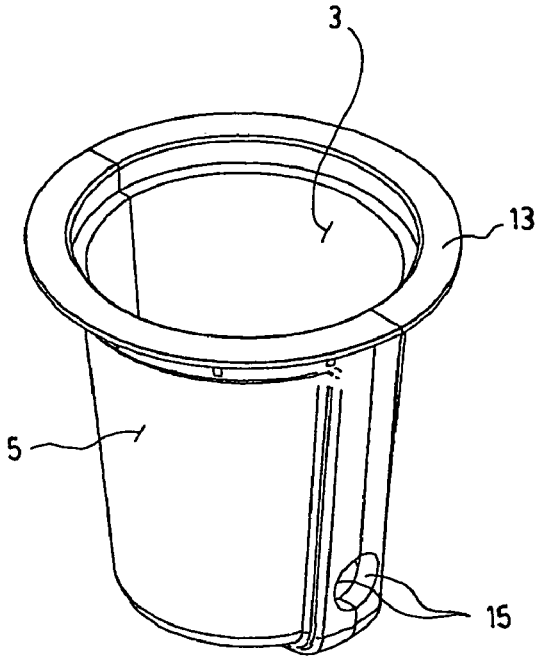
Figure 5:
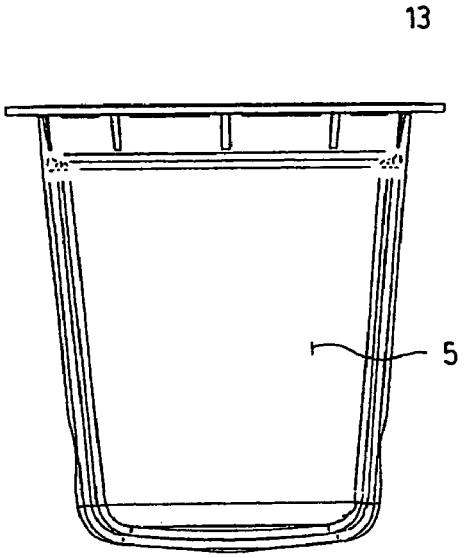
Figure 6:
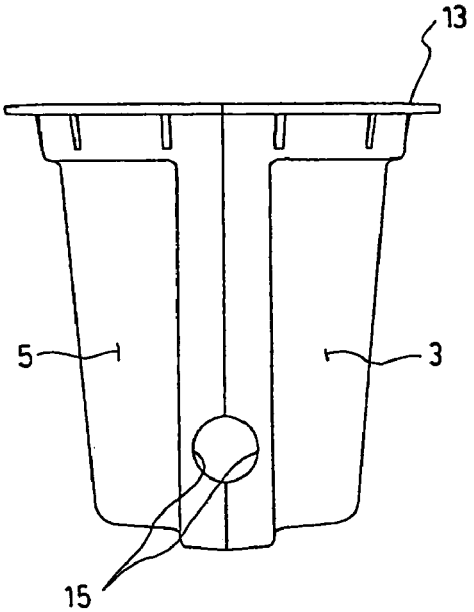
Figure 8:
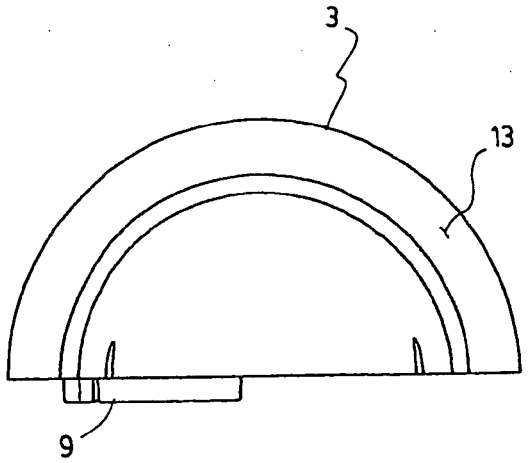
FIGS. 7, 8, 9 and 10 are respectively a perspective view, a top plan view, a front elevational and a side elevational view of one of the two elements forming the wire grommet illustrated in the previous Figures.
Figure 7:
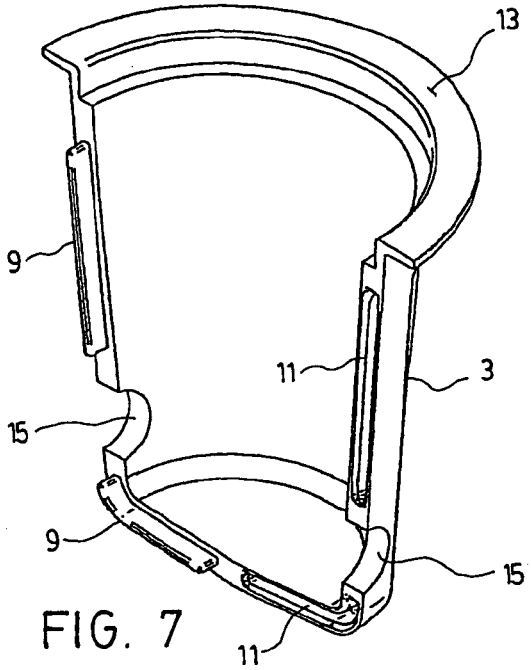
Figure 9:
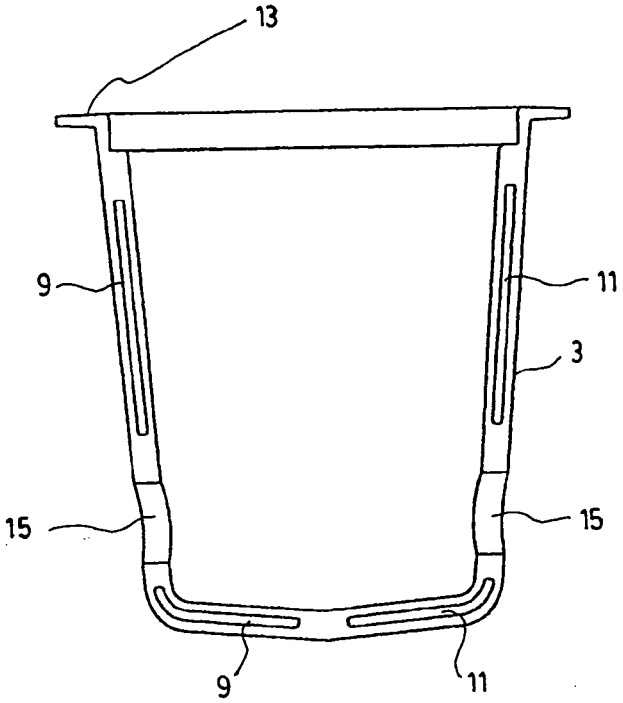
Figure 10:
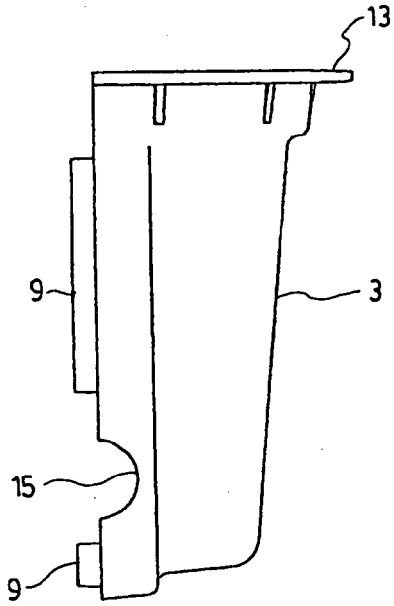

Advantageously, the wire grommet 1 according to the invention may also comprise a closing cap 17 (see FIG. 2) sized to fit onto a recess provided for this purpose in the upper part of each of the elements 3,5. The cap may be provided with an openable part 19 in order to let the electric wire pass through it, if need be. The advantage of this closing cap is that it reduces the size of the opening and the risk of letting fall by inadvertence a pen, an eraser, or any other item that could be placed onto the panel or plate in which the wire grommet is installed.

In order to reduce as much as possible the fabrication costs, the walls of each element 3,5 can be molded in a very thin manner. The parts of the elements that act as supporting means or as connecting means must however be thicker in order to provide the necessary resistance and durability.

As is clearly shown in the drawings, the two elements that form the wire grommet according to the invention are identical. The mold used for manufacturing the wire grommet is made of two very simple parts, including a male part and a female part to form each grommet. The mold is however preferably devised in such a manner as to comprise two identical male parts and two identical female parts so as to form two identical elements at the same time. The advantage of this molding is that it permits to obtain the requested wire grommet without using expensive mechanical components. Such permits to improve the production costs.

It can be understood that once installed, the wire grommet according to the invention as shown in an assembled manner, in FIGS. 1 and 3 to 6, permits to avoid that objects placed on the panel or plate fall by inadvertence into the hole where the wire grommet has been installed. Thanks to its structure and shape, this wire grommet may also act as a pen holder. It can be understood however that it could also be used for other storage purposes.

The invention claimed is:

1. A wire grommet to be positioned into a hole in a surface of a panel or plate, said grommet comprising:

two identical elements having opposing elongated edges provided with mating tongues and grooves allowing assembly of said elements to form a container with an open top end, a closed bottom end opposite said open top end, and being of a size and shape adapted to allow it to be inserted into the hole and be maintained within the same;

each of said elements having at least one recess in at least one of the opposing edges positioned to form, when said elements are assembled, at least one opening above said closed bottom end through which one or more wires may pass, while allowing said container to act as a containment part in which objects can be inserted and held; and further comprising a closing cap fittable into both elements when said elements are assembled to close the open end of the container formed by said two elements.

2. The wire grommet of claim 1, wherein said elements are made of molded plastic material.

3. The wire grommet of claim 1, wherein said at least one opening is located close to the closed bottom end of the container.

4. The wire grommet of claim 1, wherein said closing cap is provided with an openable part for allowing one or more wires to pass through said closing cap.

5. A wire grommet to be positioned in a hole in a surface of a panel or plate, said grommet comprising:

two identical elements having opposed elongated edges provided with mating tongues and grooves allowing their assembly to form an open container with an open top end, a closed bottom end opposite to said open top end, and being of a size and shape adapted to allow the assembled elements to be inserted into and maintained within the hole, said elements also have at least one recess in at least one of the opposed edges which form, when said elements are assembled, at least one opening through which one or more wires may pass, each said at least one opening being located above and close to the closed bottom end of the container, said closed bottom to allow said container to act as a containment part in which objects can be inserted and held, and a closing cap fittable into the open top end of said container when said elements are assembled to close the open end of the container formed by said two elements, and an openable part in said closing cap for allowing one or more wires to pass through said closing cap.

* * * * *